United States Patent [19]

Marinescu et al.

[11] Patent Number: 4,955,420

[45] Date of Patent: Sep. 11, 1990

[54] CORD LOCKING MECHANISM

[75] Inventors: Florin Marinescu, Tega Cay, S.C.; Bakulesh N. Patel, Charlotte, N.C.; William M. Hammond, Irvine, Calif.

[73] Assignee: CHF Industries, Inc., Charlotte, N.C.

[21] Appl. No.: 422,524

[22] Filed: Oct. 17, 1989

[51] Int. Cl.[5] ..... E06B 9/324

[52] U.S. Cl. ..... 160/178.2; 160/168.1; 24/136 A

[58] Field of Search ..... 160/178.2, 178.1, 168.1, 160/176.1, 166.1; 24/136 A, 136 R

[56] References Cited

U.S. PATENT DOCUMENTS

| | | | |
|---|---|---|---|
| 2,129,606 | 9/1938 | Nisenson | 160/178.2 X |
| 3,952,789 | 4/1976 | Marotto | 160/178.2 X |
| 4,245,688 | 1/1981 | Vecchiarelli | 160/178.2 |
| 4,463,791 | 8/1984 | McClure | 160/178.2 |
| 4,646,808 | 3/1987 | Anderson | 160/178.2 |
| 4,660,612 | 4/1987 | Anderson | 160/178.2 X |
| 4,719,956 | 1/1988 | Valle | 160/178.2 |

*Primary Examiner*—Blair M. Johnson
*Attorney, Agent, or Firm*—Thomas E. Smith

[57] ABSTRACT

A locking mechanism for the control cords of a window blind extends partially into the headrail of a window blind, and a cord separation member on the portion of the mechanism within the headrail has discrete openings through which the cords pass and are separated as they enter the mechanism. A guide pin is positioned transversely across the upper end of the mechanism with one end of the guide pin being disposed nearer the separation member and lower than the other end, so that the cords passing over the pin may be rotated to a selected side of this portion of the mechanism. A cord gripping means is mounted below the guide pin, and includes a fixed gripping member disposed centrally within the second portion of the mechanism, and a movable gripping member is mounted within this second portion of the mechanism for gripping the cords therebetween. The separation member, guide pin and movable gripping member are all positionable alternatively for either left hand or right hand operation of the locking mechanism. A clip having downwardly depending legs and outwardly extending end portions wider than the opening in the headrail is inserted downwardly through the top of the headrail behind the front panel of the headrail to lock the locking mechanism in place within the opening in the headrail.

12 Claims, 3 Drawing Sheets

CORD LOCKING MECHANISM

BACKGROUND OF THE INVENTION

This invention relates to a cord locking mechanism for the control cords of a window blind or the like, and particularly to a cord locking mechanism which will firmly and simultaneously grip a number of control cords, and which can be quickly mounted and selectively operated in either a right hand or left hand position.

Quite frequently, window blinds, such as pleated window shades, are operated by a number of cords which extend down the blind or shade at intervals and control the raising and lowering of the shade. The locking mechanism, which is mounted to one side or the other on the headrail of the blind or shade, locks the cords in place and thus permits the blind or shade to be locked into a selected raised position, and the mechanism must be capable of handling several cords. The problem has been that with a multitude of cords, the cords invariably become twisted and bunched, making it difficult for the locking mechanism to grip all of the cords firmly and simultaneously.

In addition, a cord locking mechanism may be used on either side of the window blind, so that the control cords may be located at either side, and it is preferable that each individual locking mechanism be capable of either left hand or right hand operation so that the inventory of locking mechanisms can be minimized. Moreover, the locking mechanism must be capable of being mounted quickly and easily in position on the headrail of the shade or blind.

With the present invention, the locking mechanism separates the cords and maintains them in a separated condition so that they may be individually and uniformly gripped within the locking mechanism, and twisting and bunching of the cords will be minimized. The cords are thus firmly and simultaneously gripped. The locking mechanism constructed in accordance with the invention is adapted for either left hand or right hand operation, with a simple reorientation of several parts of the mechanism, and it may be quickly and easily mounted in position on the headrail of the blind or shade.

SUMMARY OF THE INVENTION

In accordance with this invention, a cord locking mechanism is provided for a plurality of cords of a window blind or the like, into which the window cords extend in a substantially horizontal direction and from which the cords extend in a substantially vertical direction. The mechanism includes a cord separation means, for separating the cords substantially horizontally as they enter the mechanism. A guide means is positioned inwardly from the cord separating means, and the cords extend over this guide means substantially horizontally and from the guide means substantially vertically. Cord gripping means is positioned below the guide means, and includes a pair of gripping members for receiving the cords between them. At least one of the gripping members is movable selectively either toward the other gripping member to grip the cords and prevent vertical upward movement of the cords, or away from the other gripping member to release the cords and permit vertical upward movement of the cords therebetween.

The locking mechanism preferably has an inner body portion and an outer body portion. The inner body portion is adapted to be inserted into the headrail of the blind, and houses the cord separation means, and the outer body portion is adapted to abut the headrail of the blind and house the guide means and the cord gripping means.

It is preferred that a substantially U-shaped resilient clip, having downwardly pending legs and outwardly extending end portions, be providing for insertion behind the front panel of the headrail through the top of the headrail in order to lock the mechanism in place with the outer body portion abutting the outside of the headrail, and the end portions of the clip abutting the inside of the headrail.

It is preferred that the cord separation means consist of a separation member having a plurality of discrete openings for accommodating and separating the cords, and that there be means for removably attaching this cord separation member to the inner body portion of the mechanism in one of two alternate oblique positions, so that the cords may enter the separation member alternatively from either side of the inner body portion. It is also preferred that the guide means consist of a guide pin and a means for mounting the guide pin transversely across the upper end of the outer body portion, alternatively in one of two positions, with one guide pin end disposed nearer the inner body portion and lower than the other guide pin end, so that the cords passing over the guide pin may be rotated to a selected side of the outer body portion.

It is further preferred that one of the gripping members of the cord gripping means be mounted in fixed position centrally within the outer body portion, and that the second gripping member be mounted alternatively on one side or the other of the first gripping member for movement toward and away from the first gripping member to respectively grip and release the cords, and permit selective left hand or right hand operation of the locking mechanism.

DETAILED DESCRIPTION OF THE PREFERRED EMBODIMENT

Figure 1:
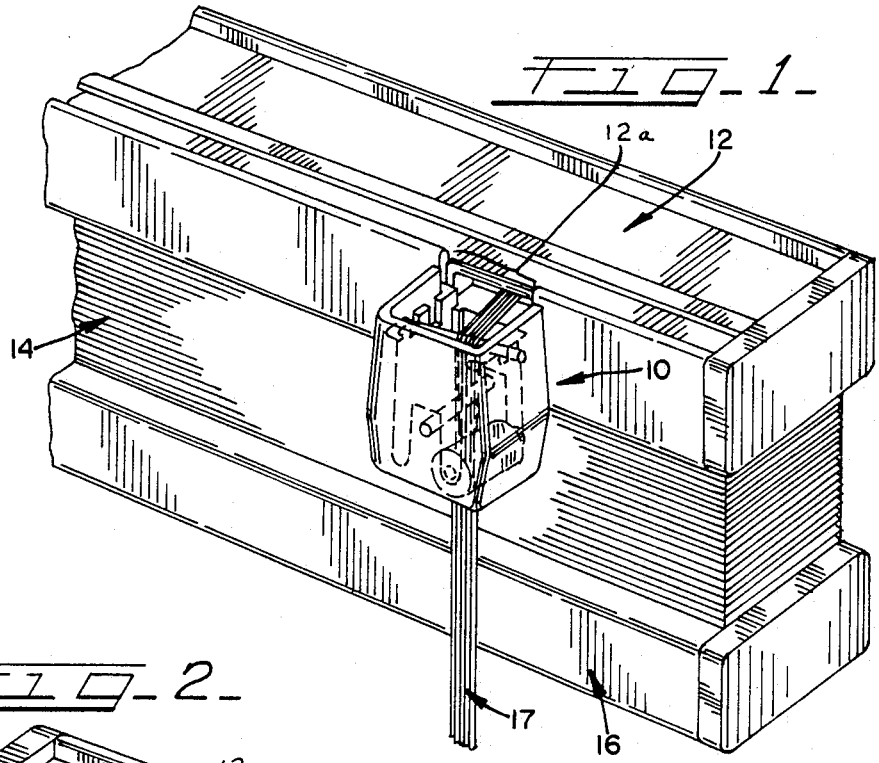
FIG. 1 is a perspective view of the cord locking mechanism constructed in accordance with this invention mounted on the right side of the headrail of a pleated shade, with the cords coming into the mechanism from the left side and exiting on the right side.
Figure 2:
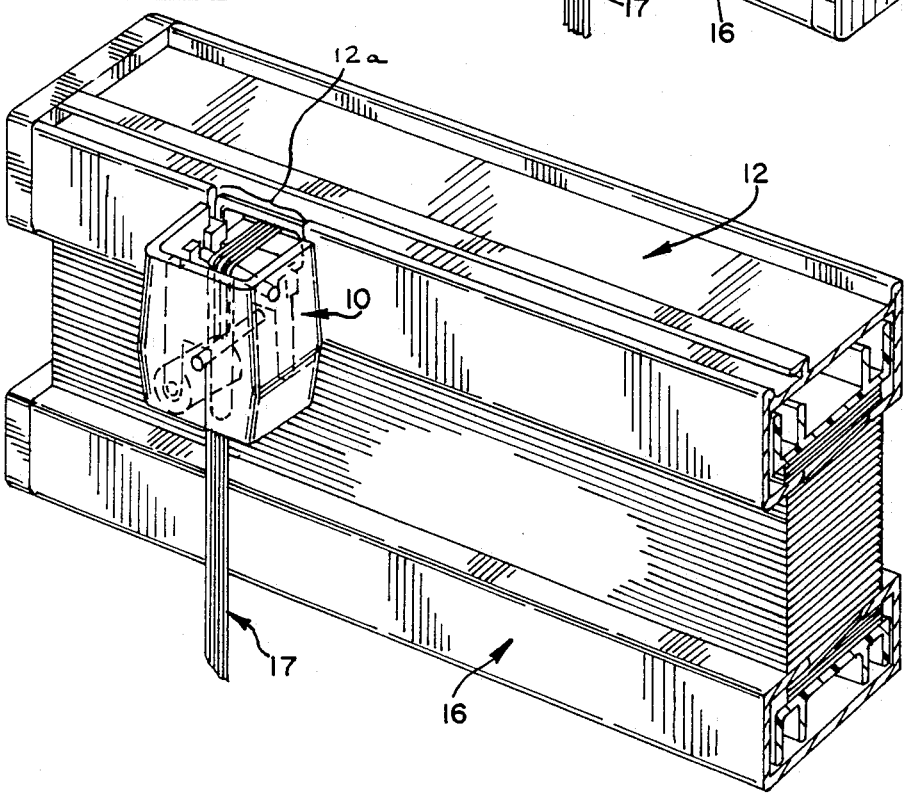
FIG. 2 is a perspective view of the cord locking mechanism mounted on the left side of the headrail of a pleated shade, with the cords coming into the mechanism from the right side and exiting from the mechanism on the left side.

The cord locking mechanism 10 of this invention is illustrated in FIGS. 1 and 2 mounted on the headrail 12 of a pleated window shade 14 having a bottom rail 16. The window shade, including the headrail 12 and the bottom rail 16, is of standard construction with a plurality of cords 17 extending through the headrail 12, and then downwardly to engage the bottom rail 16 so that the bottom rail may be raised and lowered as desired in the usual and well-known manner. The locking mechanism 10 is adapted for right hand and left hand operation, that is, for mounting on either the left hand side or the right hand side of the headrail 12. The mechanism is mounted within an opening 12*a* on the front face of the headrail 12. In FIG. 1, the mechanism 10 is shown mounted on the right hand side of the headrail, and in FIG. 2, the mechanism is shown mounted on the left hand side of the headrail.

Figure 3:
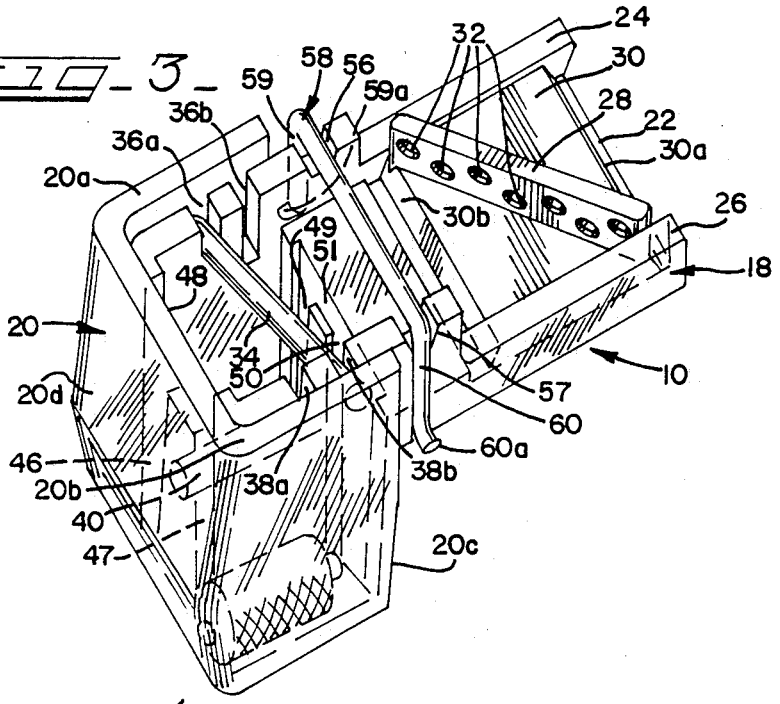
FIG. 3 is a perspective view of the cord locking mechanism.

The locking mechanism 10 is best illustrated in FIG. 3, and includes a body consisting of a horizontal first or inner body portion 18 and a vertically extending second or outer body portion 20. In the preferred embodiment, these two body portions 18 and 20 are integrally formed and molded of a plastic material, although they could be formed separately and molded of any other type of material.

The inner body portion 18 has a flat bottom 22 and a pair of parallel siderails 24 and 26. The upper portions of the siderails 24 and 26 extend inwardly toward each other for a slight distance, and thus overhang the bottom 22 of the inner body portion to provide grooves adjacent the bottom 22 of this inner body portion.

Figure 4:
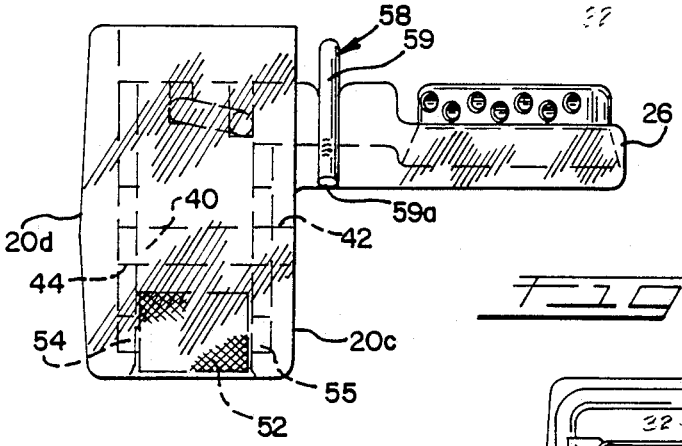
FIG. 4 is a side elevational view of the cord locking mechanism illustrated in FIG. 3.
Figure 5:
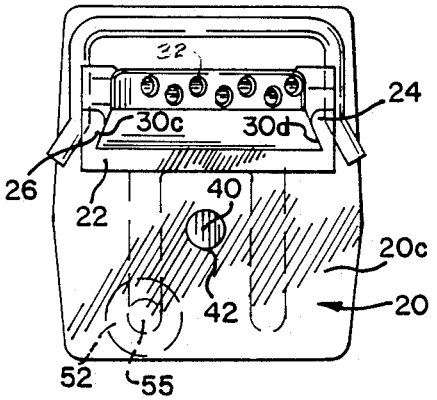
FIG. 5 is a rear elevational view of the cord locking mechanism illustrated in FIG. 3
Figure 7:
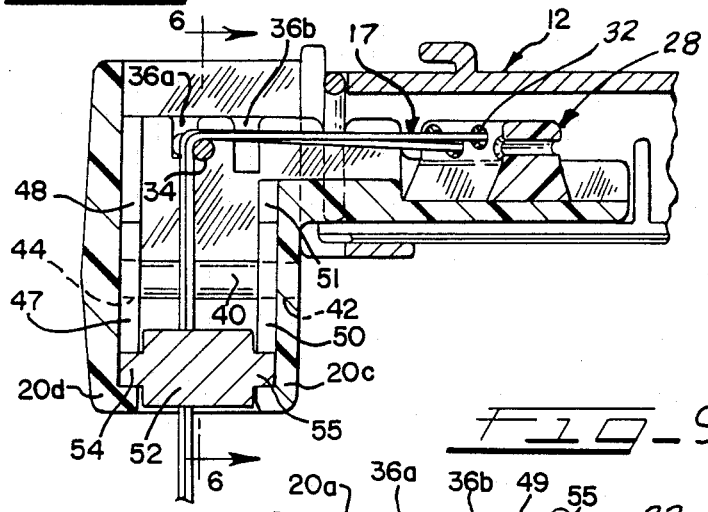
FIG. 7 is a sectional elevational view of the cord locking mechanism taken substantially along line 7—7 of FIG. 6.
Figure 8:
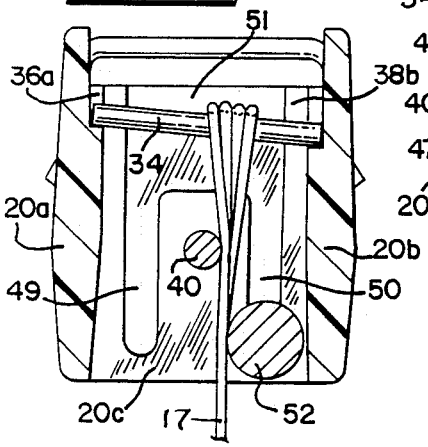
FIG. 8 is a sectional elevational view of the cord locking mechanism taken substantially along line 8—8 of FIG. 7.
Figure 9:
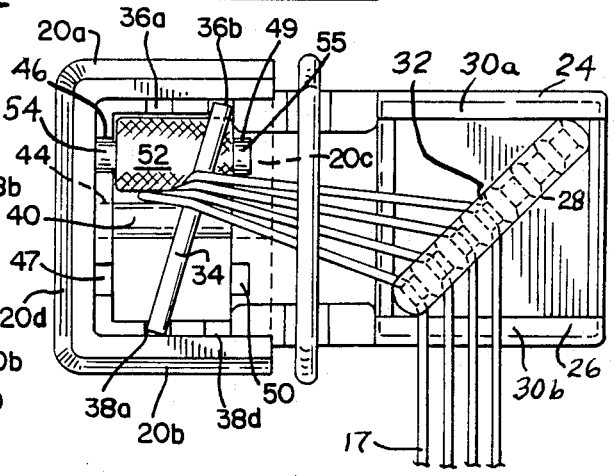
FIG. 9 is a top plan view of the cord locking mechanism showing the cords coming into the mechanism from the right side of the mechanism.

A cord separator 28 has an integral flat base 30 which is substantially square and has four downwardly sloping sides, 30*a*, 30*b*, 30*c* and 30*d*. The upper portion of the cord separator 28 is a rectangular block having a plurality of round holes 32 therein, and it extends diagonally across the square base 30. The holes 32 are staggered as best seen in FIGS. 3–5 where 7 holes are shown. This arrangement results in total separation of the cords and accommodates nearly twice as many cords as could be accommodated by other separation means, such as for example pins. The downwardly sloping sides 30*a–d* of the separator base fit within parallel grooves formed by the siderails 24 and 26 of the inner body portion 18, and since the separator base 30 is square, the separator 28 may be orientated with its appertured upper portion disposed either diagonally in the orientation of FIGS. 3 and 6 or diagonally in the orientation of FIG. 9, depending upon whether the sloping sides 30*c* and 30*d* are in engagement with the rails 24 and 26 as shown in FIGS. 3 and 5, or whether the sloping sides 30*a* and 30*b* are in engagement with these rails as shown in FIG. 9. The cord separator 28 and its base 30 may be removed by sliding the base to the right as viewed in FIGS. 2 and 4, and it may be reinserted in either the right hand or the left hand orientation. It will be noted that the two alternative positions of the separator 28 are substantially perpendicular to each other. The cord separator 28 separates the cords as they enter into the cord locking mechanism 10 from the headrail 12 of the window shade, as best shown in FIGS. 6–9.

The outer body portion 20 of the cord locking mechanism is hollow, having side walls 20*a* and 20*b*, a rear wall 20*c* and a front wall 20*d*. Across the top of this outer body portion there is positioned a single guide pin 34 the orientation of which is unique and serves to hold the cords in their separated condition while directing them within the hollow outer body portion 20. In order to mount this guide pin in its desired position of adjustment, there are provided on the left hand side of the outer body portion a pair of slots 36*a* and 36*b*, and on the right hand side, there are corresponding slots 38*a* and 38*b*. The innermost slots, 36*b* and 38*b*, are longer (deeper) than the outermost slots 36*a* and 38*a*, and the guide pin 34 in the right hand orientation of the mechanism as viewed in FIGS. 3 and 4, is disposed with one end in slot 36*a* and the other in slot 38*b*. In this orientation the right hand end of the pin 34 will be disposed nearer the inner body portion 10 than the left hand end, and the right hand end of the pin will also be disposed lower than the left hand end because the slot 38*b* is longer than the slot 36*a*.

Figure 6:
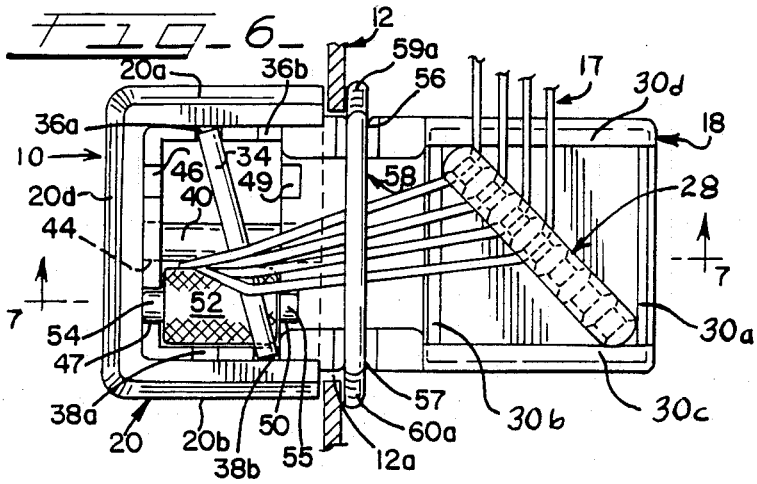
FIG. 6 is a top plan view of the locking mechanism, showing the cords entering the mechanism from the left side, and showing the manner in which the cord locking mechanism is locked in place within the headrail of the blind.

This inwardly and downwardly angled orientation of one end of the pin from the other end guides the cords 17 to one side or the other of the interior of the outer body portion 20, as may be seen from a comparison of FIGS. 6 and 9. In the left hand orientation as shown in FIG. 9, the pin 34 extends between the slot 38*a* and the slot 36*b*, with the end of the pin in slot 36*b* being disposed inwardly nearer the inner body portion 18 and lower than the end of the pin which is disposed in slot 38*a*. Thus the cords 17 will be directed to the left hand side of the interior of the outer body portion 20 in this orientation of the guide pin 34.

Disposed within the hollow outer body 20, below the guide pin 34, is a fixed gripping member 40 in the form of a pin which extends through a through-hole 42 in the rear side of the outer body portion 20 (see FIG. 5). The opposite end of the fixed gripping member pin 40 extends into a blind hole 44 in front wall 20*d* of the outer body portion. The pin 40 thus is mounted in fixed position centrally in the interior of the hollow outer body portion 20 below the guide pin 34, and it extends axially, i.e. between the front face 20*d* and the rear face 20*c* of the outer body portion.

Carved in the interior of the front wall 20*d* of the outer body portion 20 are a pair of vertical channels 46 and 47, which are connected at the top by a carved-out horizontal connecting portion 48. A similar pair of channels 49 and 50 are carved in the interior of the rear wall 20*c* of the outer body portion and these channels are connected at the top by a carved-out horizontal connecting portion 51. The slots 46, 47, 49 and 50 provide a mounting for a movable gripping member 52 in the form of a roller having a knurled surface. This movable gripping member or roller 52 has outwardly extending axle ends 54 and 55 which fit within the opposing channels in the front and rear walls 20*d* and 20*c* of the outer body portion 20. In FIGS. 1 and 3–8, this roller 52 is mounted with the axle ends 54 and 55 in the channels 47 and 50 respectively. The axle ends and channels are of such size that the movable gripping member knurled roller 52 may move upwardly in the channels freely and may rotate freely. The channels are preferably so located and the roller 52 of such size that the roller will not freely move past the fixed pin 40 but it may be pushed past this pin by a small force. After the roller 52 has been forced upwardly past the fixed pin 40 the axle ends 54 and 55 will reach the carved-out portions 48 and 51 in the front and rear walls of the outer body portion. These carved-out horizontal connecting portions are in effect horizontal channels through which the axle ends 54 and 55 of the roller move beneath the guide pin 34. The roller may be moved within these horizontal channels laterally over the fixed pin 40 and beneath the guide pin 34, without removing the guide pin, until the axles 54 and 55 reach the vertical channels 46 and 49, at which time the movable gripping member roller may move downwardly and be forced past the fixed gripping member pin 40 on the left side to the bottom of the slots 46 and 49, and to the position illustrated in FIGS. 2 and 9.

This capability of moving the roller 52 from one set of vertical channels to the other within the body portion 20, without removing the guide pin 34 is important. The roller will stay in proper orientation during this movement and cannot drop out of the body 20 because the angularly disposed guide pin 34 will prevent it. Of course once the roller 52 has been repositioned the guide pin 34 may then be removed and repositioned as has been described.

It is preferred that the knurled roller 52 be coated with a high lubricity, environmentally and chemically resistant coating. One such coating which has been found particularly useful an aerospace coating called Everlube 6150 manufactured by EM Corporation of West Lafayette, Ind. This is an aluminum pigmented coating, qualified to Boeing Material Specification BMS 10-85E, Type I, Class A and Class B and designed to meet National Aerospace Standard NAS 4006. This prevents binding of the roller 52 against the inner walls **20*c* and 20*d***. This coating is controlled dimensionally to aerospace tolerance controls (+/−0.0002 inches) to prevent build-up, but allows sufficient coating and lubricity to provide for continuous, dependable operation and movement of the roller.

As may be best seen in the perspective view FIGS. 1 and 2, and in the top plan views of FIGS. 6 and 9, the outer body portion 20 of the cord locking mechanism is wider than the inner body portion 18. The inner body portion is of a width and height which will permit it to pass through the opening **12*a* in the front face of the headrail 12. This may be seen in FIGS. 6 and 7. The opening 12*a* extends upwardly into the top of the headrail 12, which is shown in FIG. 7 and in FIGS. 1 and 2. A pair of vertical channels 56 and 57 are formed on opposite sides of the inner body portion 18, spaced just inwardly from the junction of that body portion with the outer body portion 20. A substantially U-shaped metal clip 58 has downwardly depending legs 59 and 60, the ends 59*a* and 60*a*** of which are flared outwardly.

When the inner body portion 18 is inserted into the opening **12*a* of the headrail 12, the shoulders formed by the sidewalls 20*a* and 20*b* of the outer body portion will abut the front face of the headrail 12 outside of the opening 12*a*, and clip 58 may be inserted downwardly through the opening which extends into the top of the headrail. The downwardly depending legs 59 and 60 of the clip will be guided by the vertical channels 56 and 57 respectively, and the outwardly flared end portions 59*a* and 60*a*, which must be squeezed inwardly in order to pass into the opening 12*a* in the top of the headrail, resume their normal flared-out position behind the front face of the headrail 12, as best shown in FIG. 6. Thus, the clip 58 will lock the cordlock mechanism 10 in position within the opening 12*a* of the headrail 12, with the shoulders formed by the sidewalls 20*a* and 20*b* of the outer body portion 20 engaging the outside surface of the headrail front wall and the outwardly-flared end portions 59*a* and 60*a* of the clip 58** engaging the inside surface of the headrail front wall.

The cord locking mechanism 10 is adapted to be operated in either the left hand or the right hand position, that is, either to the right or the left side of the headrail 12. In FIG. 1, the right side operation is shown, and in FIG. 2, the left hand operation is shown. In order to prepare the cordlock for the right hand operation, the knurled roller forming the movable gripping member 52 is inserted into the outer body portion 20 through the top, with the axle ends 54 and 55 in the vertical channels 47 and 50 respectively. Pressure is applied to the knurled roller to move it downwardly past the fixed gripping member pin 40 to the bottom of the slots 47 and 50.

Next, the diagonal guide pin 34 is inserted, one end being disposed in slot **36*a* of the sidewall 20*a*, and the other end resting in slot 38*b* of the sidewall 20*b* of the outer body portion. Since the slot 38*b* is closer to the inner body portion 18 than the slot 36*a*, the pin 34 will be diagonally oriented as shown in FIG. 6, and since the slot 38*b* is longer than the slot 36*a*, the bottom of the pin which is nearest the inner body portion 18 will also be lower than the opposite end of the pin 34. The cord separator 28 is then assembled in the inner body portion 18 in the right hand position as shown in FIGS. 1 and 6. The cord separator 28 is diagonally angled so that the cords 17 may enter it from the left. This means that the sides 30*d* and 30*c* of the separator base 30 are inserted in the grooves formed by the side rails 24 and 26 as shown in FIGS. 5 and 6. The cords 17 are then inserted through the apertures 32 in the cord separator 28. They are pulled over the guide pin 34, and then inserted downwardly between the fixed gripping pin member 40 and the movable gripping member knurled roller 52 as shown in FIGS. 6 and 7. The cords 17 exit from the cord locking mechanism 10** in a vertical direction.

To lock the cords in position, they may be pulled vertically downwardly and then allowed to move upwardly. Since in this vertical position the cords will engage the knurled surface of the movable gripping member roller 52, the roller will be drawn upwardly in the slots 47 and 50 as the cords are allowed to move upwardly until the cords 17 are pinched between the fixed gripping member pin 40 and the movable gripping member knurled roller 52 to lock the cords in position as shown in FIGS. 6–8. To release the cords, the cords are angled to the left in FIG. 1 and pulled downwardly. This will release the movable gripping member 52, and it will drop to the bottom of the channels 47 and 50. The cords may then move upwardly through the cord locking mechanism and into the headrail 12.

In rigging the locking mechanism 10 for left hand operation, the movable gripping member 52 is inserted on the left hand side of the cord mechanism outer body portion 20, as shown in FIGS. 2 and 9, with the end axle ends 54 and 55 extending into the channels 46 and 49 on the left hand side of the outer body member interior. The guide pin 34 is inserted across the top of the outer body portion diagonally opposite to that of the right hand rigging, with the left hand end of the pin being in slot **36*b* and the right hand end being in slot 38*a*. Since slot 36*b* is longer than slot 38*a*, the left hand end of the pin will be lower and will be angled toward the inner body portion 18 of the mechanism, as illustrated in FIG. 9**.

The cord separator 28 is then assembled in the inner body portion 18 in the left hand position as shown in FIG. 9, with the downwardly sloping sides 30*a* and 30*b* of the separator base 30 disposed within the grooves formed under the upwardly and inwardly extending side rails 24 and 26. The cords are then threaded through the apertures 32 from the right hand side and are passed over the guide pin 34 as illustrated in FIG. 9, and then downwardly between the fixed gripping member pin 40 and the movable gripping member roller 52. The operation of the locking mechanism 10 in the left hand position is identical with that of the right hand operation except that the movable gripping member roller 52 is released from gripping engagement with the cords by pulling the cords downwardly and to the right.

It may be seen that the cords are separated uniquely by the apertured cord separator 28, each of the cords 17 extending through a separate one of the apertures 32 in the cord separator. The guide pin 34 is oriented similarly to that of the cord separator. That is, in the right hand rigging the right end of the pin 34 will be disposed inwardly from the left end and the right end of the separator 28 will also be disposed inwardly from the left end (See FIG. 6). In the left hand rigging, the left end of the pin 34 will be disposed inwardly from the right end and the left end of the separator will be disposed inwardly of the right end. Since the end of the guide pin 34 nearest the inner body portion 18 and the separator 28 is lower than the opposite end of the pin, the cords which have been separated by the separator 28 will be guided or rotated to the right side of the interior of the outer body portion 20 of the mechanism, and then downwardly between the fixed gripping member pin 40 and the movable gripping member knurled roller 52. As they extend from the separator 28, over the guide pin 34 and between the gripping members 40 and 52, the cords will remain separated and they will be prevented from bunching and overlapping one another, thereby assuring that there will be a firm grip on all of the cords, and that they will be gripped evenly and uniformly between the movable gripping member knurled roller 52 and the fixed gripping member pin 40.

The foregoing description has been given by way of example, and numerous modifications may be made in the specific structure illustrated without departing from the spirit and scope of the invention as hereinafter claimed.

What is claimed is:

1. A locking mechanism for a plurality of cords of a window blind or the like and into which the cords extend in a substantially horizontal direction and from which the cords extend in a substantially vertical direction, said mechanism comprising cord separating means for separating the cords substantially horizontally as they enter said mechanism, said cord separating means including an obliquely disposed separation member having an integral base and upper portion, said upper portion having a plurality of separate holes therethrough, each hole for accommodating a single cord, oblique guide means positioned outwardly from said cord separating means and over which the cords extend substantially horizontally and from which the cords extend substantially vertically, cord gripping means positioned below said guide means and including first and second gripping members for receiving the cords therebetween, at least one of said gripping members being selectively movable toward the other gripping member to grip the cords and prevent vertical upward movement of the cords therebetween and movable away from the other gripping member to release the cords and permit vertical upward movement of the cords therebetween.

2. The structure of claim 1 wherein said locking mechanism further includes a body having a horizontal first portion extending axially to meet a vertically extending second portion, said cord separating means include, and means for removably attaching said separation member to said body first portion selectively in one of two alternate positions which are oblique with respect to the horizontal axis of said body first portion and substantially normal to each other.

3. The mechanism of claim 1 wherein said obliquely disposed guide means is a transversely extending guide pin one end of which is disposed nearer to said cord separating means than the other end.

4. The structure of claim 3 wherein said locking mechanism further includes a body having a horizontal first portion and a hollow vertically extending second portion, pin mounting means adjacent the juncture of said body first and second portions for mounting said guide pin transversely at an angle across the upper end of said body second portion.

5. The locking mechanism of claim 4 wherein said pin mounting means has formations for engaging and holding the ends of said guide pin, with one of said guide pin ends disposed nearer to said body first portion than the other, whereby the cords will be rotated to one side of said body second portion.

6. The locking mechanism of claim 5 wherein said pin mounting means has alternative formations for engaging and holding the ends of said guide pin so that the pin may be mounted selectively with either of said guide pin ends disposed nearest to said body first portion, whereby the cords may be rotated selectively to either side of said body second portion.

7. The locking mechanism of claim 6 wherein said pin engaging formations are so formed that the end of said guide pin nearest to said body first portion will be lower than the other end of said guide pin in both of the selected alternative positions of the guide pin.

8. The mechanism of claim 1 wherein the holes through said separation member upper portion are in staggered relationship with respect to one another, whereby said holes may be more densely packed to accommodate an increased number of cords.

9. A locking mechanism for a plurality of cords of a window blind or the like and into which the cords extend in a substantially horizontal direction and from which the cords extend in a substantially vertical direction, said mechanism comprising a body having a horizontal first portion and a hollow vertical second portion joined to said first portion at its upper end; a cord separation member having a plurality of discrete openings for accommodating and separating the cords, and means for removably attaching said cord separating member to said body first portion selectively in one of two alternative oblique positions relative to said body first portion, whereby the cords may enter said separation member alternatively from either side of said body first portion; a guide pin, means for mounting said guide pin transversely across the upper end of said body second portion alternatively in one of two positions with one of said guide pin ends disposed nearer to said body first portion, whereby the cords passing over said guide pin may be rotated to a selected side of said second body portion; and cord gripping means comprising a first gripping member mounted in fixed position centrally within said body second portion, a second gripping member and means within said body second portion for mounting said second gripping member within said body second portion alternatively on one side or the other of said first gripping member for movement toward and away from said first gripping member to respectively grip and release the cords and permit selective left hand or right hand operation of said locking mechanism.

10. The locking mechanism of claim 9 in which said guide pin is mounted in said guide pin mounting means with the end of the guide pin disposed nearer to said body first portion also disposed lower than the other guide pin end.

11. A locking mechanism for a plurality of cords of a window blind or the like and into which the cords extend in a substantially horizontal direction and from which the cords extend in a substantially vertical direction, said mechanism comprising a body having a horizontal first portion, cord separating means on said body first portion for separating the cords substantially horizontally as they enter said mechanism, an obliquely disposed guide means positioned inwardly from said cord separating means at the upper end of a vertically extending hollow body second portion and over which the cords extend substantially horizontally and from which the cords extend substantially vertically, a first gripping member mounted in fixed position within said hollow body second portion, a second gripping member, means provided within said hollow body second portion for mounting said second gripping member for movement toward and away from said first gripping member, said means for mounting said second gripping member including a first pair of substantially vertical channels within said hollow body second portion at one side of said first gripping member for engaging and guiding the movement of the ends of said second gripping member toward and away from said fixed first gripping member, a second pair of channels within said hollow body second portion at the other side of said first gripping member for engaging and guiding the movement of the ends of said second gripping member toward and away from said first gripping member, the upper ends of said pairs of channels being connected by a pair of transverse channels connecting the upper ends of said pairs of substantially vertical channels above said fixed first gripping member and beneath said angularly disposed guide means, whereby said movable second gripping member may be moved selectively from one pair of substantially vertical channels to the other for left-hand or right-hand operation of said locking mechanism.

12. The structure of claim 11 wherein said second gripping member is a knurled roller which is coated with a high lubricity, environmentally and chemically resistant coating to prevent said knurled roller from binding within said first pair of channels as it is being moved toward or away from said fixed first gripping member.

* * * * *